US006954534B2

(12) United States Patent
Pace et al.

(10) Patent No.: US 6,954,534 B2
(45) Date of Patent: Oct. 11, 2005

(54) MULTIPLE SIGNAL CARRIER TRANSMISSION APPARATUS AND METHOD

(75) Inventors: Ronald G. Pace, Naperville, IL (US); Michael K. Pedigo, Zionsville, IN (US); Terry A. Melkey, Indianapolis, IN (US)

(73) Assignee: Kima Wireless Technologies, Inc., Chicago, IL (US)

( * ) Notice: Subject to any disclaimer, the term of this patent is extended or adjusted under 35 U.S.C. 154(b) by 474 days.

(21) Appl. No.: 10/193,554

(22) Filed: Jul. 11, 2002

(65) Prior Publication Data

US 2003/0031323 A1 Feb. 13, 2003

Related U.S. Application Data

(60) Provisional application No. 60/304,542, filed on Jul. 11, 2001.

(51) Int. Cl.[7] ..... H04H 5/00
(52) U.S. Cl. ..... 381/2; 381/14; 381/16
(58) Field of Search ..... 381/2–4, 6, 10–12, 381/14–16; 455/59

(56) References Cited

U.S. PATENT DOCUMENTS 4,703,501 A * 10/1987 Sugai et al. ..... 381/10
5,155,769 A * 10/1992 Werrbach ..... 381/7
5,349,386 A * 9/1994 Borchardt et al. ..... 348/485
5,581,617 A * 12/1996 Schotz et al. ..... 381/14
5,682,431 A * 10/1997 Ohnishi et al. ..... 381/7
6,215,981 B1 4/2001 Borchardt et al. ..... 455/42
6,256,303 B1 7/2001 Drakoulis et al. ..... 370/344
6,658,115 B1 * 12/2003 Lam ..... 381/2
2004/0101143 A1 * 5/2004 Avalos et al. ..... 381/2

* cited by examiner

*Primary Examiner*—Xu Mei
(74) *Attorney, Agent, or Firm*—Young & Basile, P.C.

(57) ABSTRACT

A multiple signal carrier transmission apparatus and method for broadcasting stereo sounds to an audio output device uses three related carrier frequencies on which are modulated the sum of first and second stereo channel signals and the first and second stereo channel signals themselves. The composite multiple carrier frequency signal is transmitted to a receiver which separates the three carrier frequency signals to generate a separate left channel signal, a right channel signal and a composite center channel, monophonic, signal which is the sum of the first and second channel signals. A detector monitors the signal strength of each separate left and right channel signal to detect a decrease in either channel output below a threshold. When a decrease below the threshold is detected, the center sum signal replaces the left and/or right channel signal having the diminished signal strength for output through the appropriate speaker to minimize channel fade out.

9 Claims, 8 Drawing Sheets

MULTIPLE SIGNAL CARRIER TRANSMISSION APPARATUS AND METHOD

CROSS-REFERENCE TO CO-PENDING APPLICATION

This application claims the benefit of the priority date of the U.S. Provisional Application Ser. No. 60/304,542, filed Jul. 11, 2001, the entire contents of which are incorporated herein in its entirety.

BACKGROUND

The present invention relates, in general to wireless signal transmission systems and, more particularly, to stereo sound wireless transmission systems.

In wireless transmission systems particularly suited for transmitting a radio and/or an audio portion of a television broadcast, and, even more particularly, to wireless transmission systems for music, stereo sound is desirable.

While two separate signals are combined in stereophonic transmission systems, the sound signals are spatially divided into two 50 Hz to 15 kHz audio left and right channels. Music or sounds that originate on the left side are reproduced only in the left speaker, with music or sounds that originated on the right side reproduce only on the right speaker.

While two separate transmitter and receiver systems could be used for separately broadcasting the left channel and right channel sounds to stereo speakers, headphones, etc., the present state of the art utilizes frequency division multiplexing to form a composite baseband signal as shown in FIG. 1. A standard FM stereo system uses frequency division multiplexing to combine the left and right channel signals which are in the 50H3 passband. The left and right channel signals are added to produce a sum signal and, also, subtracted from one another to produce a difference signal. The sum signal is a monophonic signal which is used for broadcast from a single speaker. The different signal is used as a double-sideband suppressed carrier to modulate a 38 kHz sine wave.

The double side band suppressed carrier signal is added to the sum signal and the combination sent on the transmitter's FM modulator. Other transmission frequencies in the 900 mHz range or in the 2 GHz frequency band may also be used to form the carrier on which the left and right signal information is modulated.

A monophonic receiver can filter the signals to block signals above 15 kHz and thereby reproduce only monophonic sum signal. A stereo receiver has an additional circuit after the FM demodulator which can detect a 19 kHz pilot tone which double the 38 kHz carrier signal.

Once the stereo receiver has detected the 19 kHz pilot tone indicating a stereo transmission, the stereo receiver recovers the difference information by demodulating the received signal to create the sum plus the difference signally and the sum minus the difference signals, to recreate the left and right signals for broadcast by the left and right speakers.

While the FM broadcast system effectively transmits and relatively accurately reproduces stereo sounds, FM signals are prone to interference by fading by reflection off of walls, particularly in the case of mobile receivers, such as stereo headphones as the individual wearing the headphones walks around a building and, also, by channel bleed over.

Thus, it would be desirable to provide an FM transmission and receiver system which has increased a signal to noise ratio to prevent bleed over and interference and thereby be able to recreate stereo signals having a signal to noise ratio closer to the 90 db signal to noise ratio of CDs. It would also be desirable to provide a means for compensating for fade out of one of the stereo channels, particularly in a portable receiver, as a particular channel signal decreases in signal to noise ratio.

SUMMARY

The present invention is a multiple signal carrier transmission apparatus and method which broadcasts stereo audio signals to an audio receiver for output through audio speakers with increased signal to noise ratio to minimize channel bleed over.

In one aspect, the invention is a method of transmitting discrete first and second stereo channel signals from a signal source to a receiver for broadcast through first and second channels. The method comprises the steps of:

forming a sum signal of the first and second stereo channel signals;

forming a difference signal of the first and second stereo channel signals;

developing a first stereo channel signal and a second stereo channel signal from the sum and difference signals;

modulating the first channel signal on a first carrier frequency signal;

modulating the second channel signal on a second carrier frequency signal;

modulating the sum signal on a third carrier frequency signal;

combining the first, second and sum modulated signals and the first, second and third carrier frequency signals to form a composite modulated carrier signal;

transmitting the composite signal;

receiving the composite signal; and separating the first and second stereo channel signals from the composite signal.

In another aspect, the invention is an apparatus for broadcasting first and second stereo channels from a signal source to a receiver for broadcast as first and second channels includes means for forming a sum signal of the first and second stereo channel signals, and means for forming a difference signal of the first and second stereo channel signal. Means are provided for developing a first stereo channel signal and a second stereo channel signal from the sum and difference signals. Means are also provided for modulating the first channel signal on a first carrier frequency signal. Means are also provided for modulating the second channel signal on a second carrier frequency signal and modulating the sum signal on a third carrier frequency signal. Means are also provided for combining the first, second and sum modulated signals and the first, second and third carrier frequency signals to form a composite modulated carrier signal. Means are also provided for transmitting the composite signal, receiving the composite signal, and separating the first and second stereo channel signals from the composite signal.

In another aspect, a decrease in the signal strength of at least one stereo channel below a threshold is detected and the sum signal used as a replacement for the diminished signal strength signal as long as the diminished signal strength signal remains below the preset threshold to minimize channel fade out.

The apparatus and method of the present invention minimizes the affect of interference and channel bleed over in stereo signal broadcasts by providing the separate channel signals on separate carrier signals operating at different frequencies.

BRIEF DESCRIPTION OF THE DRAWING

The various features, advantages and other uses of the present invention will become more apparent by referring to the following detailed description and drawing in which.

DETAILED DESCRIPTION

Figure 1:
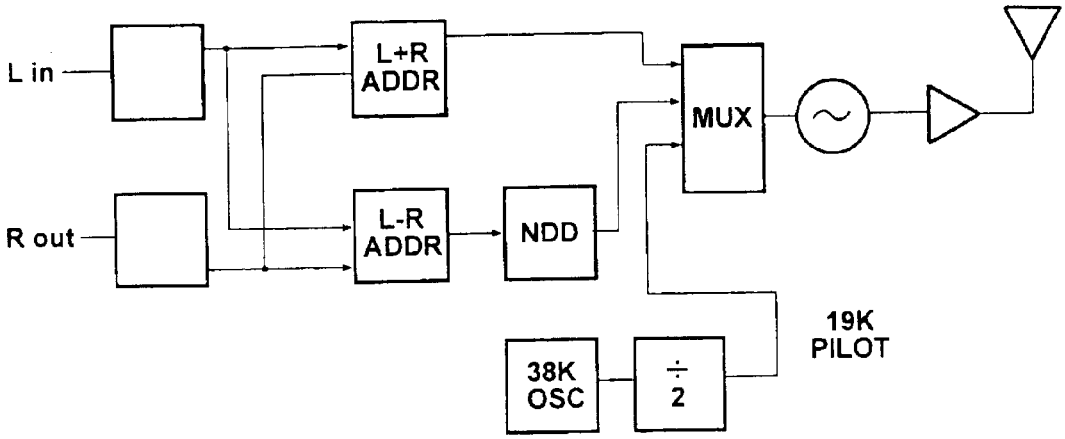
FIG - 1 PRIOR ART
FIG. 1 is a block diagram of a prior art FM broadcast transmitter circuit.
Figure 2:
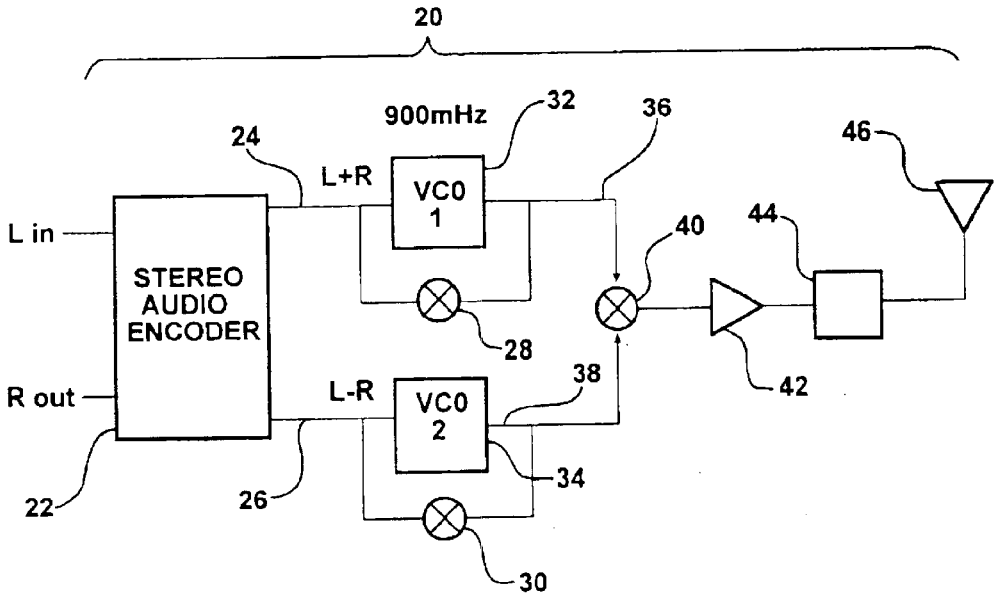
FIG. 2 is block diagram of a multiple signal carrier transmission circuit according to the present invention.
Figures 1, 3A:
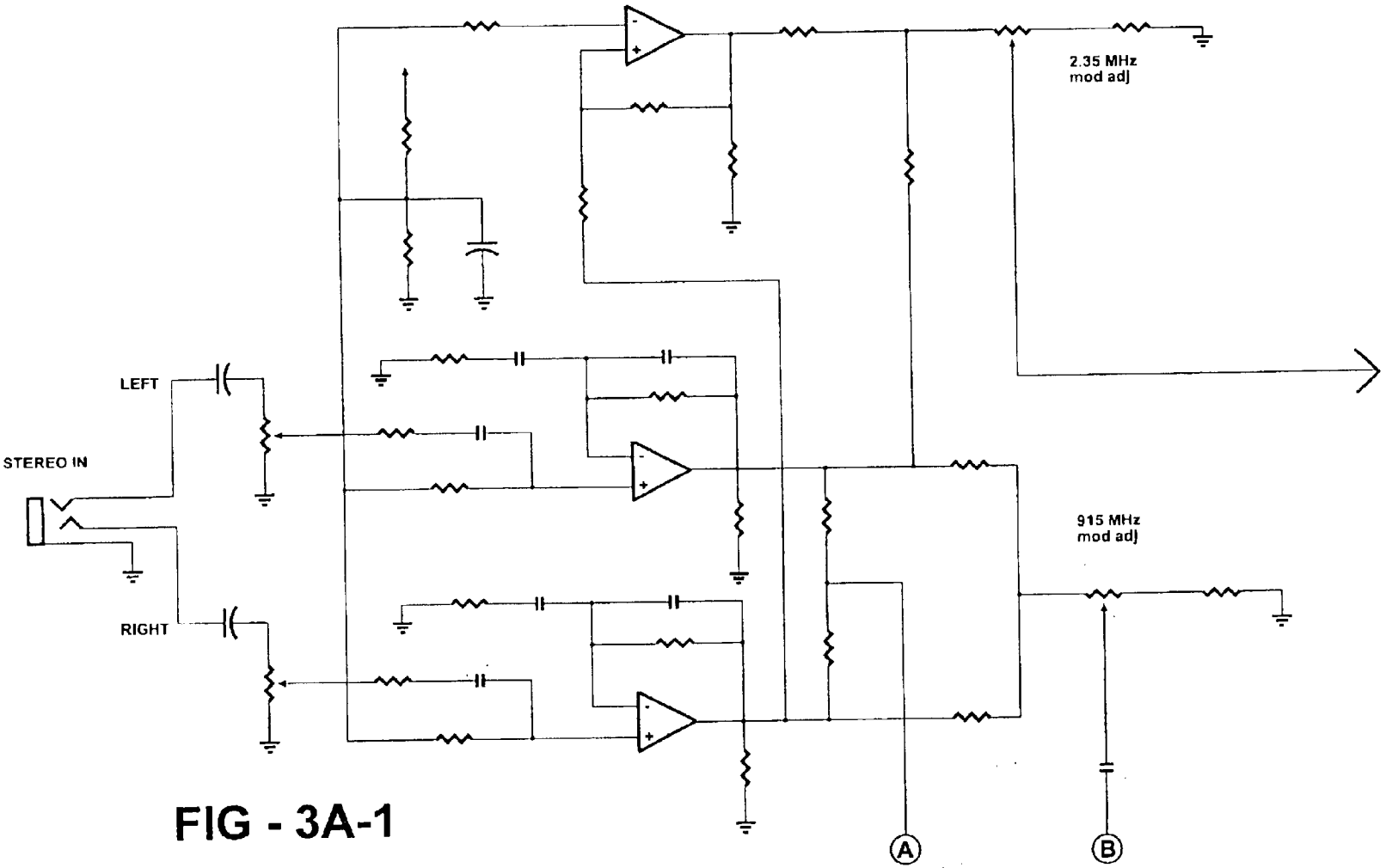
FIGS. 3A and 3B are detailed circuit diagrams of the circuit shown in FIG. 2.
Figures 2, 3A:
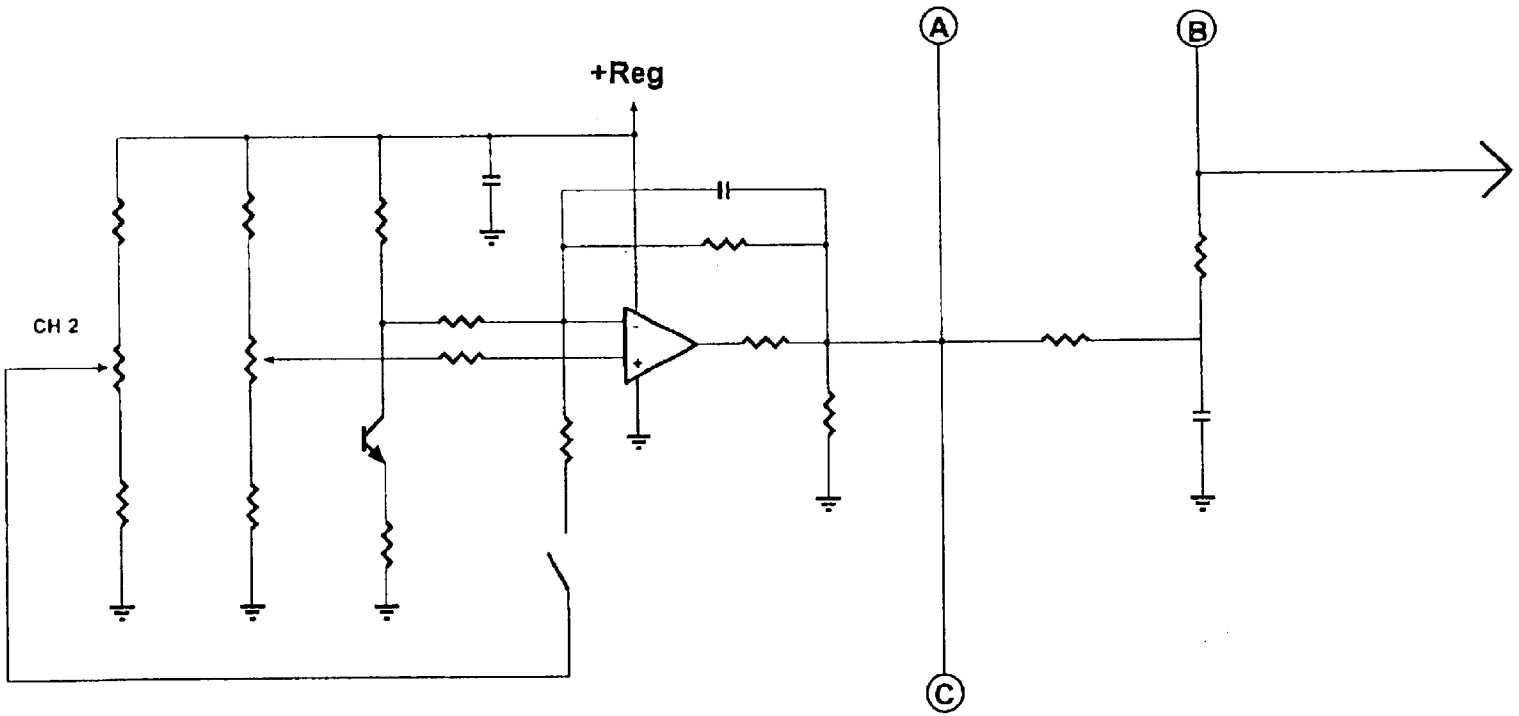
Figures 3, 3A:
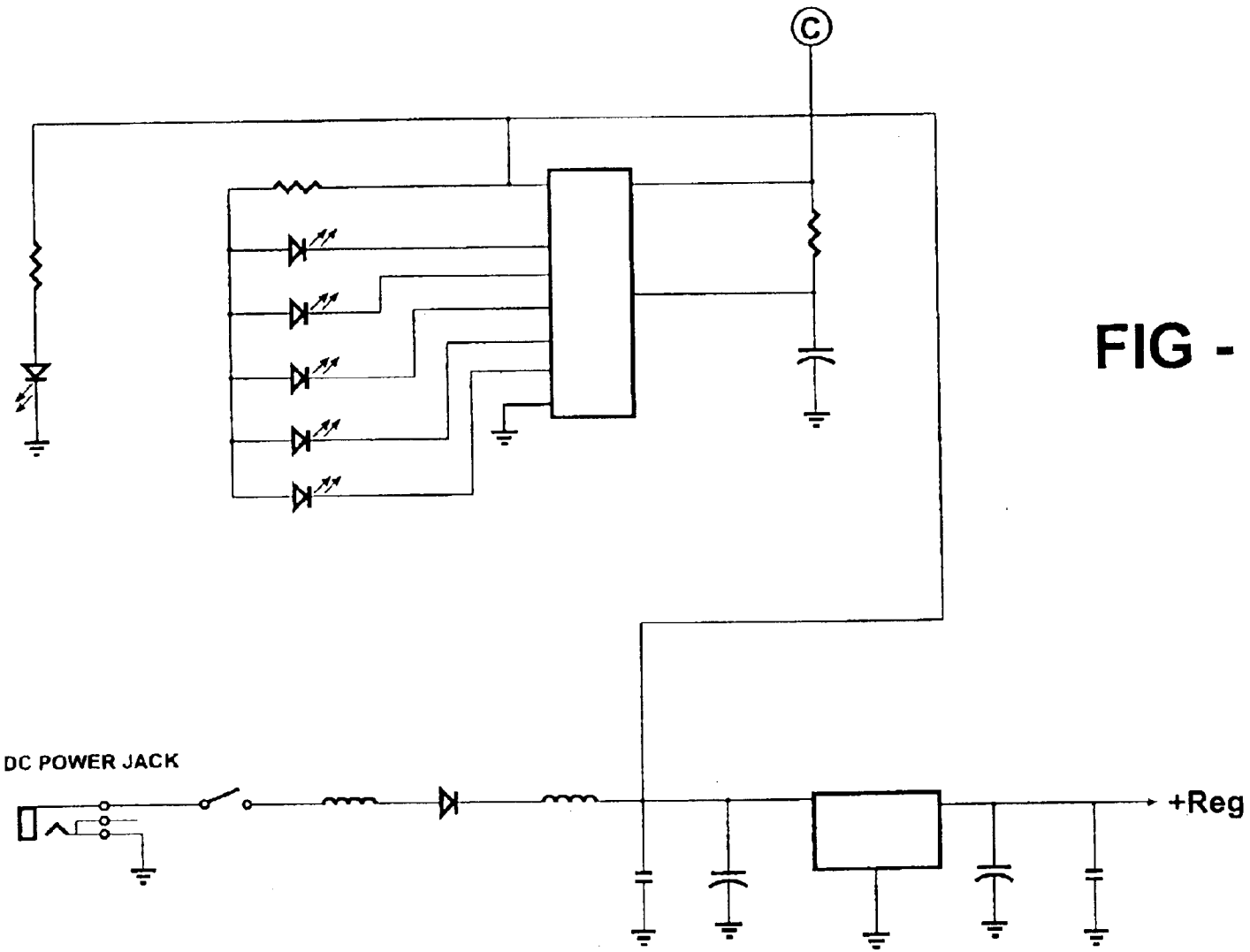
Figure 4:
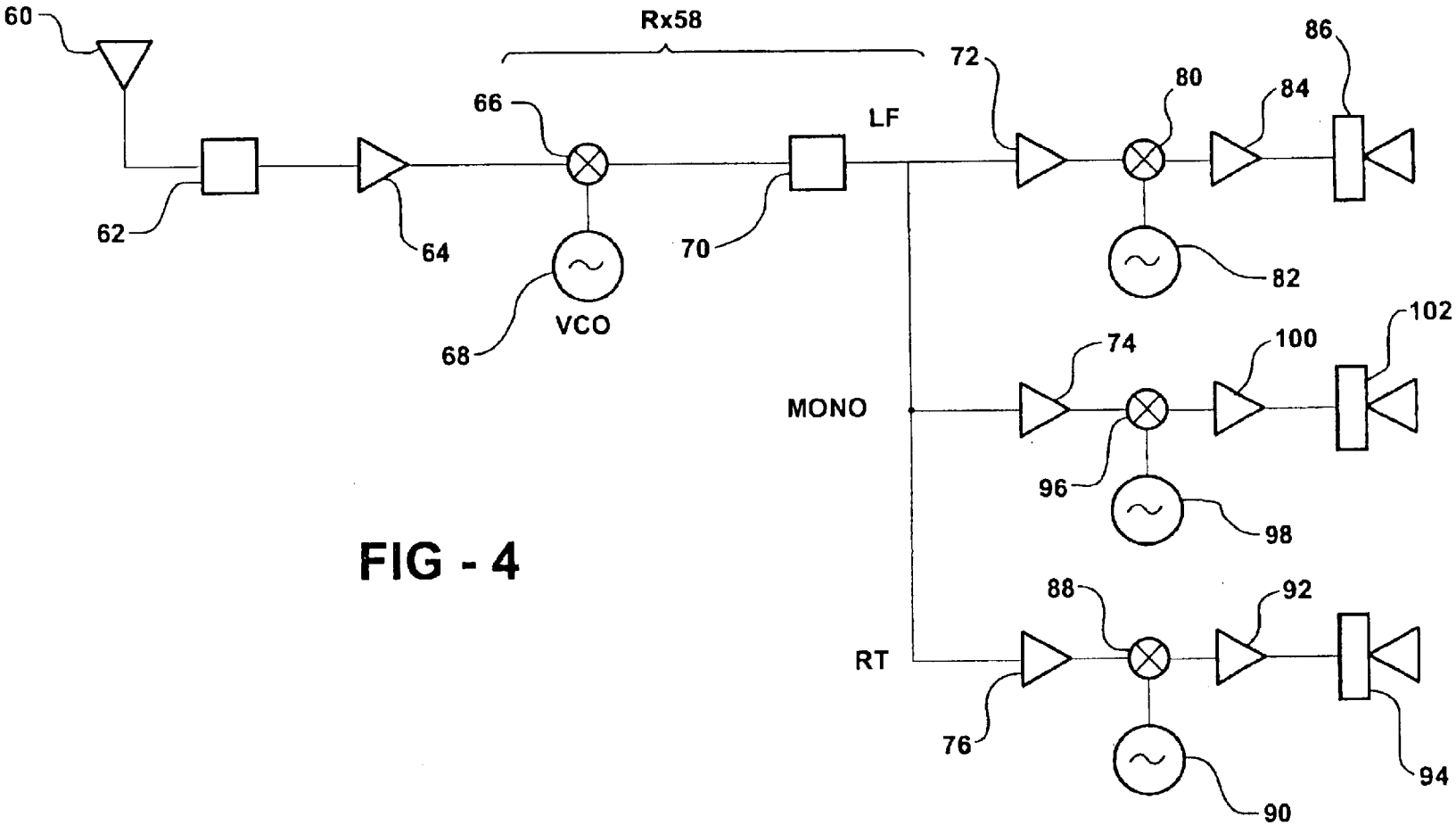
FIG. 4 is a schematic diagram of a receiver circuit useable in the present invention.

Referring now the drawings, and to FIGS. 2–4 in particular, there is depicted a multiple signal carrier transmission apparatus and method for wirelessly transmitting stereo signals between a stereo signal source and a remote receiver wherein the stereo signals are broadcast through speakers.

Figures 1, 3B:
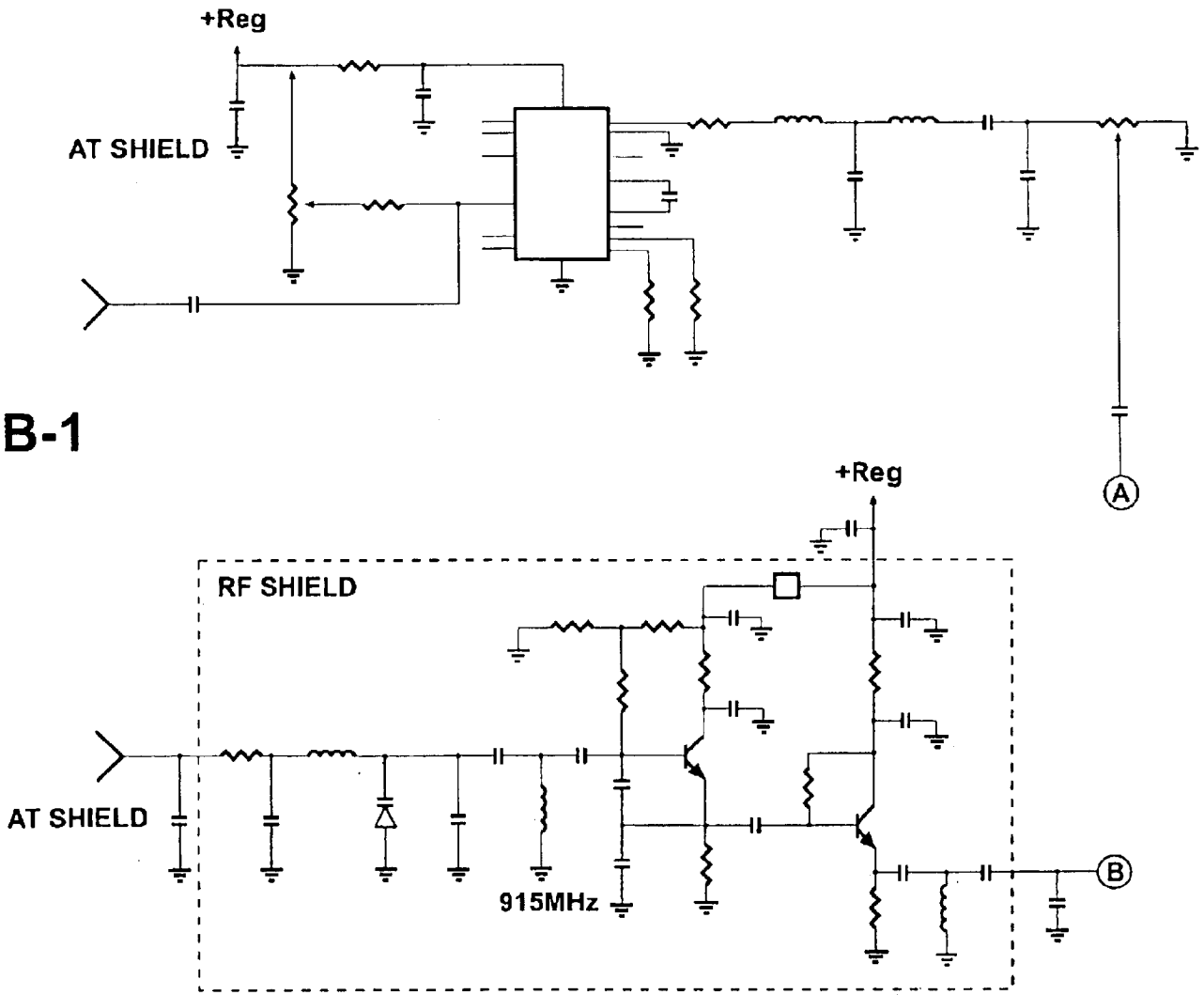
Figures 2, 3B:
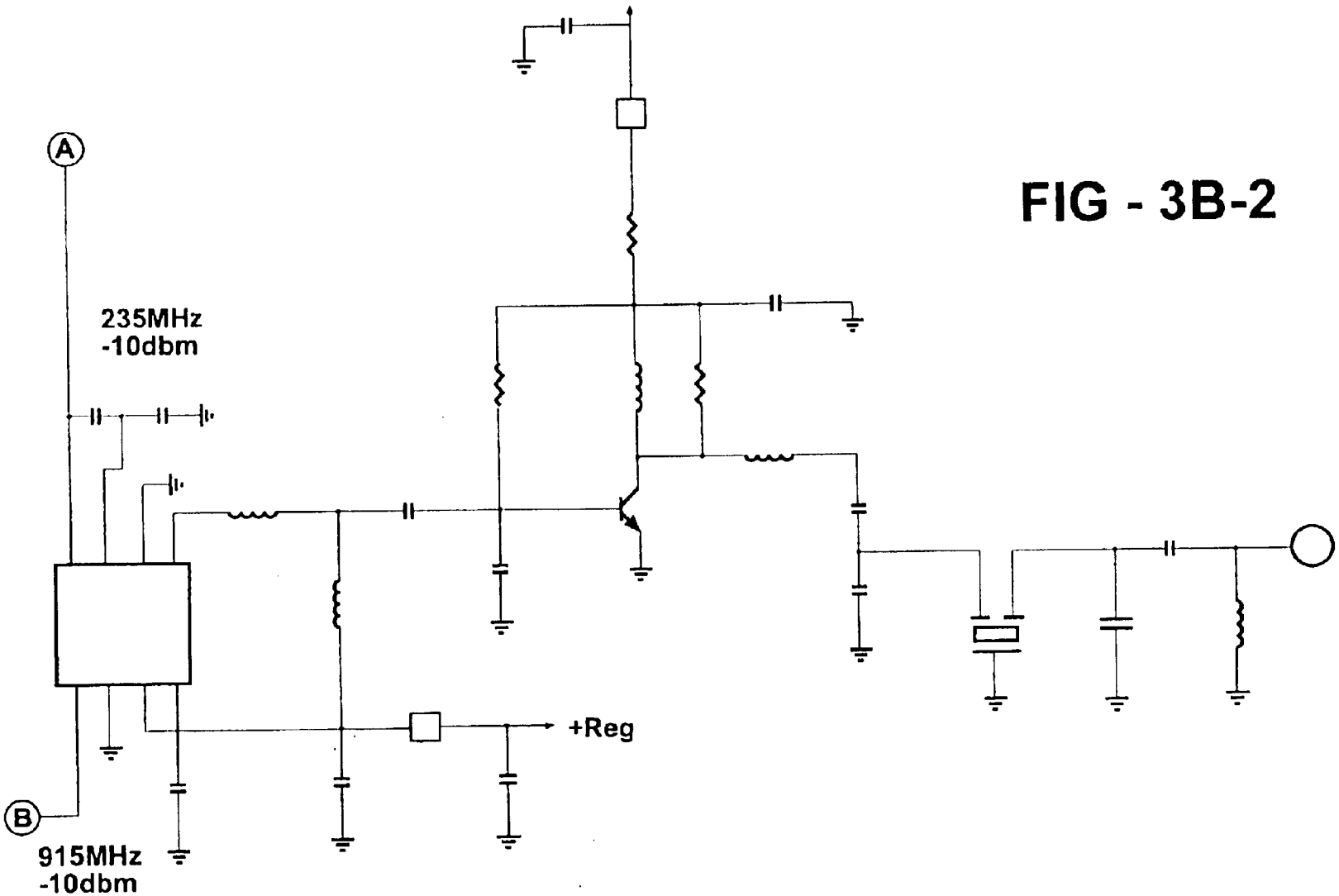

As shown in FIGS. 2, 3A and 3B, according to one aspect of the present invention, a transmitter apparatus 20 receives stereo input signals L and R from a separate stereo signal source, not shown. The stereo signal source may be any source of stereo audio or video signals including a stereo radio broadcast, Internet streaming media, and audio from a recorded media, such as CDs, MP3 players, etc. The left and right signals are input to a stereo audio encoder 22 which performs simple addition and subtraction operations to output two signal streams, a first signal stream 24 comprising the sum of the input signals (L+R). The second output signal stream 26 is the difference between the input signals (L−R). Each signal stream 24 and 26 from the stereo encoder 22 is input to a separate modulator 28 and 30, respectively. Another input to each modulator 28 and 30 is the output of one of first and second local voltage controlled oscillators 32 and 34, respectively. The oscillation frequency of the first oscillator 32 is within the 900 MHz broadcast band, such as between approximately 900 and 928 MHz. 915 MHz is described hereafter, by way of example only, as it is in the center of this range. Thus, the 915 MHz carrier signal from the first voltage controlled oscillator 32 acts as a carrier signal over which is modulated the sum signal steam 24. Similarly, the output signal from the second voltage controlled oscillator 34 is input to the mixer 30 where it is modulated by the difference signal 26. The oscillation frequency of the second voltage controlled oscillator 34 is chosen so as not to extend outside the 900 MHz band when added to or subtracted from the selected 915 MHz center frequency of the first voltage controlled oscillator 32 as described hereafter. Thus, by way of example only, the frequency of oscillation of the second voltage controlled oscillator 34 is 2.35 MHz.

The modulated carrier signals 36 and 38 from the mixers 28 and 30, respectively, are input to a doubled balanced, non-linear mixer 40. The non-linear mixer 40, sold by Maxim as chip number MAX2673, performs subtraction and addition operations on the carrier signals 36 and 38 separate from any additional signals modulated thereon. Thus, the non-linear mixer 40 outputs three separate frequency signals, one being the 915 MHz or center frequency of the first voltage controlled oscillator 32, a second 912.65 MHz frequency which is the difference between the 915 MHz center frequency and the 2.35 MHz frequency of the second voltage controlled oscillator 34, and a third 917.35 MHz frequency formed by the sum of the 915 MHz center frequency and the 2.35 MHz frequency of the second voltage controlled oscillator 34. In the above example, with 915 MHz constituting the center frequency, the three output frequencies from the double balanced, nonlinear mixer 40 function as a composite signal formed of three carrier signals at 915 MHz, 912.65 MHz, and 917.35 MHz.

Each carrier signal passes through an Rf amplifier 42 and an Rf filter 44 before being passed to an antenna for wireless transmission.

FIG. 4 represents a typical receiver circuit which can be incorporated into a stereo FM receiver, or other audio equipment. An antenna 60 receives the three carrier frequency signals from the transmitter 20 and passes each signal through a filter 62 and amplifier 64 to an intermediate or IF mixer 66. Another input to the IF mixer 66 is a local voltage controlled oscillator (VOC) 68 operating at an intermediate frequency (IF). The mixer 66 outputs sum and difference output signals between each of the carrier frequency signals and the frequency of the VCO 68. One of these outputs is discarded and the other passed through a first intermediate frequency filter 70. The output of the filter 70 is split into three signals, each first passing through an amplifier 72, 74 and 76, respectively. The three signals comprise the left stereo channel signal, a monophonic channel signal and the right stereo channel signal.

The left stereo channel modulated on the second carrier frequency is input to a mixer 80 which receives another input from a local voltage controlled oscillator 82. The frequency of the VCO 82 is selected to match the IF second carrier frequency thereby stripping the IF frequency from the signal leaving pure left channel stereo audio signals. These signals are amplified in amplifier 84 and supplied to a speaker 86. Similarly, the right stereo channel signals, after passing though amplifier 76, are input to a mixer 88 which receives the output of a local voltage controlled oscillator 90, again oscillating at the IF third carrier frequency. The difference output of the mixer 88 is selected to strip the IF frequency from the input signal thereby leaving only pure right stereo channel audio signals which are amplified in amplifier 92 and supplied to speaker 94.

The center carrier frequency is supplied through amplifier 74 to mixer 96 which receives another input from a local voltage controlled oscillator 98 operating at the IF center frequency. The monaural signal represents the sum of the left and right channel signals or L+R. This sum signal is amplified in amplifier 100 and supplied to a speaker 102 for monophonic sound output, if desired.

Although multiple carrier frequencies have been described as being transmitted by the transmitter 10 and received by the receiver 58 for broadcast of left and right stereo signals, additional carrier frequencies with modulated signals may also be transmitted and received for generation of additional "surround sound" signals. Any of the speakers, such as speakers 86 and 94, can carry a switch which selects the operating frequency of an internally mounted voltage control oscillator, such as oscillators 82 or 90 to output the proper frequency signal for use of the respective speaker as a left channel, a right channel speaker, as well as a center speaker, and left rear and right rear surround sound speakers.

The monophonic signal speaker 102 may also carry a switch which allows its frequency selection and use as a combined L+R sum signal for monophonic operation.

Figure 5:
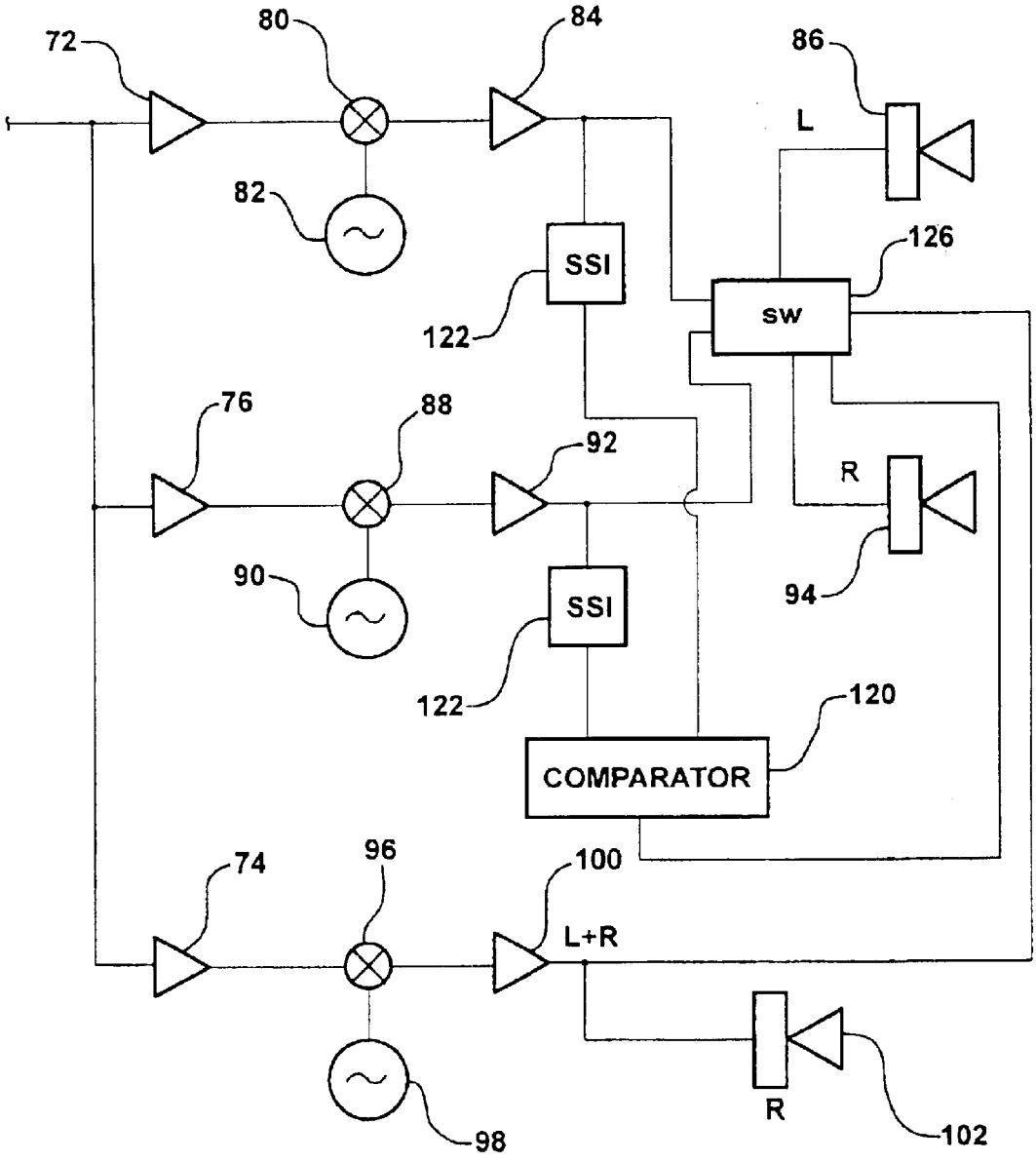
FIG. 5 is a modified receiver circuit according to the present invention.

Left and right stereo signals are known to fade or breakup due to interference, reflections, etc., as the portable speakers, i.e., headphones, move through a given area of a building. The present invention optionally provides for a gradual fade-in of the center L+R sum signal from amplifier 92 when the signal strength of the left channel output and/or the right channel output in the receiver 58 is detected as decreasing from a predetermined threshold level. As shown in FIG. 5, when the signal strength of one signal, such as the left channel signal, diminishes below a preset threshold, as indicated by an output from a comparator 120 which receives the output of signal strength indicators 122 and 124 which monitor the magnitude of the signal strength of each of the left and right signals output from the amplifiers 84 and 92, respectively, the comparator output activates a switch 126 which cuts out the left channel having the diminished signal strength and replaces the signal supplied to the left speaker 86 with the L+R sum signal from the amplifier 100. As soon as the signal strength of the left channel increases back above the threshold, the switch 126 will reapply the signal from the left channel amplifier 84 directly to the left speaker 86 and cut out the application of the L+R signal. The same switching will also apply to the right channel if the signal strength of the right channel signal decreases below the threshold. The comparator 120 and the switch 126 are also functional to simultaneously replace both of the left and right channel signals with the monophonic or L+R sum signal if the signal strength of both the left and right channels decreases below the threshold magnitude. This is smooth and instantaneous and this fade-in or switch-over capability provides a smooth, continuous audio output without any notable breaks, interruptions, dead time, etc.

In summary, the multiple carrier signal transmission apparatus and method of the present invention provides increased separation between two stereo channels.

What is claimed is:

1. A method of transmitting discrete first and second stereo channel signals from a signal source to a receiver for broadcast as first and second stereo channels, the method comprising the steps of:

forming a sum signal of the first and second stereo channel signals;

forming a difference signal of the first and second stereo channel signals;

developing a first stereo channel signal and a second stereo channel signal from the sum and difference signals;

modulating the first stereo channel signal on a first carrier frequency signal;

modulating the second stereo channel signal on a second carrier frequency signal;

modulating the sum signal on a third carrier frequency signal;

combining the first, second and sum modulated signals and the first, second and third carrier frequency signals to form a composite modulated carrier signal;

transmitting the composite modulated carrier signal;

receiving the composite modulated carrier signal; and separating the first and second stereo channel signals from the composite modulated carrier signal.

2. The method of claim 1 further comprising the steps of:

providing the third carrier frequency signal in the 900 MHz frequency band; and providing the first and second carrier frequency signals at frequencies so that the sum and difference of the first and second frequencies with the third carrier frequency remains in the 900 MHz frequency band.

3. The method of claim 1 comprising the step of:

detecting a decrease in the signal strength of one of the received, separated, first and second stereo channel signals below a threshold;

substituting a received sum signal for the first and second stereo channel signal exhibiting the decrease below the threshold.

4. The method of claim 3 further comprising the step of:

separating the sum signal from the composite modulated carrier signal.

5. An apparatus for broadcasting first and second stereo channel signals operating according to the method of claim 1.

6. An apparatus for broadcasting first and second stereo channels from a signal source to a receiver for broadcast as first and second channels, the apparatus comprising:

means for forming a sum signal of a first and a second stereo channel signals;

means for forming a difference signal of the first and second stereo channel signals;

means for developing a first stereo channel signal and a second stereo channel signal from the sum and difference signals;

means for modulating the first stereo channel signal on a first carrier frequency signal;

means for modulating the second stereo channel signal on a second carrier frequency signal;

means for modulating the sum signal on a third carrier frequency signal;

means for combining the first, second and sum modulated signals and the first, second and third carrier frequency signals to form a composite modulated carrier signal;

means for transmitting the composite modulated carrier signal;

means for receiving the composite modulated carrier signal; and means for separating the first and second stereo channel signals from the composite modulated carrier signal.

7. The apparatus of claim 6 further comprising:

means for providing the third carrier frequency signal in the 900 MHz frequency band; and means for providing the first and second carrier frequency signals at frequencies so that the sum and difference of the first and second frequencies with the third carrier frequency remains in the 900 MHz frequency band.

8. The apparatus of claim 6 further comprising:

means for detecting a decrease in the signal strength of one of the received, separated, first and second stereo channel signals below a threshold;

means for substituting a received sum signal for the first and second stereo channel signal exhibiting the decrease below the threshold.

9. The apparatus of claim 8 further comprising:

means for separating the sum signal from the composite modulated carrier signal.

* * * * *